US006465406B1

(12) United States Patent
Drapier et al.

(10) Patent No.: US 6,465,406 B1
(45) Date of Patent: Oct. 15, 2002

(54) LIQUID DISH CLEANING COMPOSITIONS HAVING IMPROVED PRESERVATIVE SYSTEM COMPRISING ETHYLENE DIAMINE-N,N-DISUCCINATE

(75) Inventors: Julien Drapier, Seraing (BE); Baudouin Mertens, Jambes (BE)

(73) Assignee: Colgate Palmolive Company, New York, NY (US)

( * ) Notice: Subject to any disclaimer, the term of this patent is extended or adjusted under 35 U.S.C. 154(b) by 0 days.

(21) Appl. No.: 10/108,136

(22) Filed: Mar. 27, 2002

(51) Int. Cl.[7] ..... C11D 17/00

(52) U.S. Cl. ..... 510/218; 510/424; 510/499; 510/525; 510/508

(58) Field of Search ..... 510/218, 424, 510/499, 505, 508

(56) References Cited

U.S. PATENT DOCUMENTS 6,147,039 A * 11/2000 Jacques et al. ..... 510/138
6,376,443 B1 * 4/2002 Julemont ..... 510/238
6,384,003 B1 * 5/2002 Julemont ..... 510/214

* cited by examiner

*Primary Examiner*—Necholus Ogden
(74) *Attorney, Agent, or Firm*—Richard E. Nanfledt

(57) ABSTRACT

A liquid dish cleaning composition with desirable cleansing properties comprising at least one anionic surfactant, a magnesium containing inorganic salt, an improved preservative system, polyethylene glycol and water.

6 Claims, No Drawings

LIQUID DISH CLEANING COMPOSITIONS HAVING IMPROVED PRESERVATIVE SYSTEM COMPRISING ETHYLENE DIAMINE-N,N-DISUCCINATE

FIELD OF INVENTION

This invention relates to a liquid dish cleaning composition which is designed to have good foaming grease cutting, rinsing and mildness properties and an improved preservative system.

BACKGROUND OF THE INVENTION

The present invention relates to novel light duty liquid detergent compositions with high foaming and good grease cutting properties and an improved preservative system.

The prior art is replete with light duty liquid detergent compositions containing nonionic surfactants in combination with anionic and/or betaine surfactants wherein the nonionic detergent is not the major active surfactant. In U.S. Pat. No. 3,658,985 an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8 to 20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition containing an alkali metal silicate, urea, glycerin, triethanolamine, an anionic detergent and a nonionic detergent. The silicate content determines the amount of anionic and/or nonionic detergent in the liquid cleaning composition. However, the foaming properties of these detergent compositions are not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to affect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylenepolyoxyethylene nonionic detergent, an anionic surfactant, a fatty acid alkanolamide and a polyoxyalkylene glycol fatty ester. But, none of the exemplified compositions contain an active ingredient mixture wherein the nonionic detergent is present in major proportion which is probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

U.S. Pat. 6,147,039 teaches an antibacterial hand cleaning composition having a low surfactant content.

SUMMARY OF THE INVENTION

It has now been found that a liquid dish cleaning composition can be formulated with at least one anionic surfactant, a magnesium containing inorganic salt, a sulfate anionic surfactant, a sulfonate anionic surfactant, polyethylene glycol, an improved preservative system and water, wherein the composition has desirable cleaning and foaming properties and an excellent resistance to bacteria.

An object of this invention is to provide a liquid dish cleaning composition which comprises at least one anionic surfactant, a magnesium containing inorganic salt, polyethylene glycol and a preservative system consisting of a preservative and a preservative potentiator, wherein the composition does not contain any silicas, abrasives, acyl isoethionate, 2-hydroxy-4,2',4'-trichloridiphenyl ether, monosuccinic acids and phosphoric acid and any salts thereof, ethylene diamine tetraacetic acid or any salt thereof, enzymes, zeolite, alkali metal silicates, phosphoric acid, boric acid, alkali metal carbonates, alkaline earth metal carbonates, alkyl glycine surfactant, cyclic imidinium surfactant, or more than 3 wt. % of a fatty acid or salt thereof.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

This invention relates to a liquid dish cleaning composition which comprises approximately by weight:

(a) 5% to 15% of at least one anionic surfactant selected from the group consisting of linear alkyl benzene sulfonates and paraffin sulfonates and mixtures thereof;

(b) 0 to 5%, more preferably 0.5% to 4% of a magnesium containing inorganic compound;

(c) 0 to 15%, more preferably 2% to 13% of a sodium salt of an ethoxylated alkyl ether sulfate;

(d) 0 to 5%, more preferably 0.1% to 4% of a polyethylene glycol;

(e) 0.0005% to 1 %, more preferably 0.001% to 0.3% of a preservative selected from the group consisting of dimethylol dimethyl hydantoin, an isothiazolone mixture and 2-bromo-2-nitropropane-1,3-diol (Myacid BT) and mixtures thereof;

(f) 0.01 % to 1.5%, more preferably 0.05% to 1% of a preservative potentiator which is preferably trisodium ethylene diamine-N,N-disuccinate; and (g) the balance being water.

This invention also relates to a liquid dish cleaning composition which comprises approximately by weight:

(a) 15% to 35% of at least one anionic sulfonated surfactant selected from the group consisting and linear alkyl benzene sulfonates and paraffin sulfonates and mixtures thereof;

(b) 0 to 5%, more preferably 0.5% to 4% of a magnesium containing inorganic compound;

(c) 0 to 12%, more preferably 0.1% to 10% of at least one ethoxylated nonionic surfactant;

(d) 0 to 5%, more preferably 0.1% to 4% of a polyethylene glycol;

(e) 0.0005% to 1%, more preferably 0.001% to 0.3% of a preservative which is selected from the group consisting of dimethylol dimethyl hydantoin, an isothiazoline mixture and 2-bromo-2-nitropropane-1,3-diol and mixtures thereof;

(f) 0.01% to 1.5%, more preferably 0.05% to 1.0% of a preservative potentiator which is preferably trisodium ethylene diamine-N,N-disuccinate;

(g) 0 to 15%, more preferably 2% to 13% of a sodium salt of an ethoxylated alkyl ether sulfate; and (h) the balance being water.

The compositions of this invention have a pH of 4 to 8 and have a viscosity of 100 to 1,000 cps, more preferably 200 to 600 cps at 25° C. using a #21 spindle at 20 rpm as measured on a Brookfield RVTDV-II viscometer, wherein the compositions do not contain any grease release agents such as choline, chloride or a buffering system which is a nitrogenous buffer which is ammonium or alkaline earth carbonate, amine oxide surfactants, ethylene diamine tetraacetic acids or any salt thereof, guanidine derivates, alkoxylalkyl amines and alkyleneamines $C_3$–$C_7$ which do not contain a hydroxy group, boric acid, phosphoric acid, amino alkylene phosphonic acid and alkyl polyglucoside surfactants and the compositions are pourable and are not a gel and have a complex viscosity at 1 $rads^{-1}$ of less than 0.4 Pascal seconds.

The anionic sulfonate surfactants which may be used in the compositions of this invention are selected from the consisting of water soluble and include the sodium, potassium, ammonium, magnesium and ethanolammonium salts of linear $C_8$–$C_{16}$ alkyl benzene sulfonates and $C_{10}$–$C_{20}$ paraffin sulfonates.

The paraffin sulfonates may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744; and 3,372,188; and also in German Pat. 735,096. Such compounds may be made to specifications and desirably the content of paraffin sulfonates outside the $C_{14-17}$ range will be minor and will be minimized, as will be any contents of di- or poly-sulfonates.

Examples of suitable other sulfonated anionic detergents are the well known higher alkyl mononuclear aromatic sulfonates, such as the higher alkylbenzene sulfonates containing 9 to 18 or preferably 9 to 16 carbon atoms in the higher alkyl group in a straight or branched chain, or $C_{8-15}$ alkyl toluene sulfonates. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

The $C_{8-18}$ ethoxylated alkyl ether sulfate surfactants have the structure $$R—(OCHCH_2)_nOSO_{-3}^{M+}$$

wherein n is about 1 to about 22 more preferably 1 to 3 and R is an alkyl group having about 8 to about 18 carbon atoms, more preferably 12 to 15 and natural cuts, for example, $C_{12-14}$ or $C_{12-16}$ and M is an ammonium cation or a metal cation, most preferably sodium. The ethoxylated alkyl ether sulfate is present in the composition at a concentration of about 2 to about 15 wt. %, more preferably about 3 to 12 wt. %.

The ethoxylated alkyl ether sulfate may be made by sulfating the condensation product of ethylene oxide and $C_{8-10}$ alkanol, and neutralizing the resultant product.

The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof.

Ethoxylated $C_{8-18}$ alkylphenyl ether sulfates containing from 1 to 6 moles of ethylene oxide in the molecule are also suitable for use in the invention compositions. These detergents can be prepared by reacting an alkyl phenol with 1 to 6 moles of ethylene oxide and sulfating and neutralizing the resultant ethoxylated alkylphenol.

The concentration of the ethoxylated alkyl ether sulfate surfactant is about 2 to about 15 wt. %.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic detergent class includes the condensation products of a higher alcohol (e.g., an alkanol containing 8 to 18 carbon atoms in a straight or branched chain configuration) condensed with 5 to 30 moles of ethylene oxide, for example, lauryl or myristyl alcohol condensed with 16 moles of ethylene oxide (EO), tridecanol condensed with 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to 14 carbon atoms in length and wherein the condensate contains either 6 moles of EO per mole of total alcohol or 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohols containing about 9–15 carbon atoms, such as $C_{9-C11}$ alkanol condensed with 8 moles of ethylene oxide (Neodol 91-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of 8–15 and give good emulsification, whereas ethoxamers with HLB values below 8 contain less than 5 ethyleneoxy groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic surfactants include the polyethylene oxide condensates of one mole of alkyl phenol containing from 8 to 18 carbon atoms in a straight- or branched chain alkyl group with 5 to 30 moles of ethylene oxide. Specific examples of alkyl phenol ethoxylates include nonyl condensed with 9.5 moles of EO per mole of nonyl phenol, dinonyl phenol condensed with 12 moles of EO per mole of phenol, dinonyl phenol condensed with 15 moles of EO per mole of phenol and di-isoctylphenol condensed with 15 moles of EO per mole of phenol. Commercially available nonionic surfactants of this type include Igepal CO-630 (nonyl phenol ethoxylate) marketed by GAF Corporation.

Also among the satisfactory nonionic surfactants are the water-soluble condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1–3.3:1, with the total of the ethylene oxide and propylene oxide (including the terminal ethanol or propanol group) being from 60–85%, preferably 70–80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being 75% by weight.

Other suitable water-soluble nonionic surfactants which are less preferred are marketed under the trade name "Pluronics." The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L62 and L64.

The magnesium inorganic compound is a magnesium oxide, sulfate or chloride. The magnesium salt or oxide provides several benefits including improved cleaning performance in dilute usage, particularly in soft water areas. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Polyethylene glycol which is used in the instant composition has a molecular weight of 200 to 1,000, wherein the polyethylene glycol has the structure $$HO(CH_2CH_2O)_nH$$

wherein n is 4 to 52. The concentration of the polyethylene glycol in the instant composition is 0.1% to 7 wt. %, more preferably 0.1 wt. % to 5 wt. %.

The preservative system used in the instant compositions is a mixture of a preservative and a preservative potentiator. The preservatives used in the instant composition are preferably selected from the group consisting of:

(i) 1,3-dimethylol-5,5-dimethylhydantoin having the structure of:

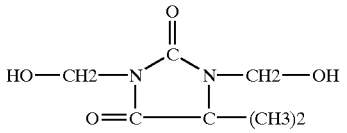

(ii) 2-bromo-2-nitropropane-1,3-idol having the structure:

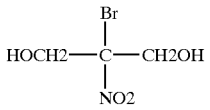

(iii) a synergistic mixture of three different isothiazolones having the structure:

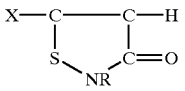

In the relative proportions of 2 to 2.5% for the 5-chloro-2-methyl-4-isothiazolin-3-one (R=CH3, X=Cl), 0.7 to 0.8% for the 2-methyl-4-isothiazolin-3-one (R=CH3, X=H) and 0.5 to 0.7% for the 2-n octyl4-isothiazolin-3-one (R=n-C8H17, X=H).

The preservative potentiator is trisodium ethylene diamine-N,N-disuccinate.

The instant light duty liquid compositions can contain about 0 wt. % to about 10 wt. %, more preferably about 1 wt. % to about 8 wt. %, of at least one solubilizing agent selected from the group consisting of a $C_{2-5}$ mono, dihydroxy or polyhydroxy alkanols such as ethanol, isopropanol, glycerol ethylene glycol, diethylene glycol, propylene glycol, and hexylene glycol and mixtures thereof and alkali metal cumene or xylene sulfonates such as sodium cumene sulfonate and sodium xylene sulfonate. The solubilizing agents are included in order to control low temperature cloud clear properties.

The instant formulas explicitly exclude alkali metal silicates and alkali metal builders such as alkali metal polyphosphates, alkali metal carbonates and alkali metal phosphonates because this material, if used in the instant composition, would cause the composition to have a high pH as well as leaving residue on the surface being cleaned.

The final essential ingredient in the inventive compositions having improved interfacial tension properties is water. The proportion of water in the compositions generally is in the range of 10% to 95%.

The liquid cleaning composition of this invention may, if desired, also contain other components either to provide additional effect or to make the product more attractive to the consumer. The following are mentioned by way of example: Colors or dyes or perfumes in amounts up to 1.0% by weight 2,6-di-tert.butyl-p-cresol, etc., in amounts up to 2% by weight for color improvement under stressed sun conditions and pH adjusting agents, such as citric acid or sodium hydroxide, as needed. Furthermore, if opaque compositions are desired, up to 4% by weight of an opacifier may be added.

Sodium chloride can be optionally added as a thickening agent at a concentration of 0.1 wt. % to 5 wt. %.

In final form, the instant compositions exhibit stability at reduced and increased temperatures. More specifically, such compositions remain clear and stable in the range of 0° C. to 50° C., especially 5° C. to 43° C. Such compositions exhibit a pH of 4 to 8. The liquid compositions are readily pourable and exhibit a viscosity in the range of 100 to 1000 milliPascal.second (mPas.) as measured at 25° C. with a Brookfield RVTDV-II Viscometer using a #21 spindle rotating at 20 RPM. Preferably, the viscosity is maintained in the range of 200 to 600 mpas.

The following examples illustrate the liquid body cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared by simple mixing procedure:

| | A | B | C | D | E |
|---|---|---|---|---|---|
| C14–17 Paraffin sulfonate | 9.1 | 9.1 | 9.1 | 9.1 | 9.1 |
| MgSO4.7H2O | 1.0 | 1.0 | 1.0 | 1.0 | 1.0 |
| Perfume | 0.13 | 0.13 | 0.13 | 0.13 | 0.13 |
| C12–13 alcohol ethoxysulfate EO2:1 | 7.5 | 7.5 | 7.5 | 7.5 | 7.5 |
| Polyethylene glycol 300 | 0.6 | 0.6 | 0.6 | 0.6 | 0.6 |
| Trisodium ethylene diamine-N,N'-disuccinate | 0.086 | 0.086 | 0.086 | 0.086 | 0.086 |
| 1,3-Dimethylol-5,5-dimethylhydantoin | — | 0.22 | — | 0.22 | — |
| Isothiazolone mixture | — | — | 0.0014 | — | 0.0014 |
| 2-bromo-2-nitropropane-1,3-diol | 0.025 | 0.015 | 0.015 | — | — |
| Sodium chloride | 2.5 | 2.5 | 2.5 | 2.5 | 2.5 |
| Water | Balance | Balance | Balance | Balance | Balance |
| pH | 6.0 | 6.0 | 6.0 | 6.0 | 6.0 |

EXAMPLE 2

The following compositions in wt. % were prepared by simple mixing procedure:

| | F | G | H | I | J |
|---|---|---|---|---|---|
| C14–17 Paraffin sulfonate | 25.0 | 25.0 | 25.0 | 25.0 | 25.0 |
| C9–11 ALCOHOL EO 7.5–8.1 | 4.5 | 4.5 | 4.5 | 4.5 | 4.5 |
| MgSO4.7H2O | 1 | 1 | 1 | 1 | 1 |
| Perfume | 0.21 | 0.21 | 0.21 | 0.21 | 0.21 |
| C12–13 alcohol ethoxysulfate EO2:1 | 4 | 4 | 4 | 4 | 4 |
| Polyethylene glycol 300 | 1 | 1 | 1 | 1 | 1 |
| Trisodium ethylene diamine-N,N'-disuccinate | 0.086 | 0.086 | 0.086 | 0.086 | 0.086 |
| 1,3-Dimethylol-5,5-dimethylhydantoin | — | 0.22 | — | 0.22 | — |
| Isothiazolone mixture | — | — | 0.0014 | — | 0.0014 |
| 2-bromo-2-nitropropane-1,3-diol | 0.020 | 0.015 | 0.015 | — | — |
| Water | Balance | Balance | Balance | Balance | Balance |
| pH | 6.0 | 6.0 | 6.0 | 6.0 | 6.0 |

What is claimed:

1. A liquid dish cleaning composition which comprises approximately by weight:

(a) 5% to 15% of at least one anionic surfactant selected from the group consisting of linear alkyl benzene sulfonates and paraffin sulfonates and mixtures thereof;

(b) 0.5% to 4% of a magnesium containing inorganic compound;

(c) 0.1% to 4% of a polyethylene glycol;

(d) 0.0005% to 0.3% of a preservative selected from the group consisting of dimethylol dimethyl hydantoin, an isothiazolone mixture and 2-bromo-2-nitopropane-1,3-diol and mixtures thereof;

(e) 0.01% to 1.5%, of a preservative potentiator which is trisodium ethylene diamine-N,N-disuccinate; and (f) the balance being water.

2. The composition of claim 1, wherein at least one said sulfonate surfactant is said paraffin sulfonate.

3. The composition of claim 1 further including a sodium salt of an ethoxylated alkyl ether sulfate surfactant.

4. A liquid dish cleaning composition which comprises approximately by weight:

(a) 15% to 35% of at least one anionic sulfonated surfactant selected from the group consisting of a linear alkyl benzene sulfonates and paraffin sulfonates and mixtures thereof;

(b) 0.5% to 4% of a magnesium containing inorganic compound;

(c) 0.1% to 10% of at least one ethoxylated nonionic surfactant;

(d) 0.1% to 4% of a polyethylene glycol;

(e) 0.0005% to 0.3% of a preservative selected from the group consisting of dimethylol dimethyl hydantoin, an isothiazolone mixture and 2-bromo-2-nitropropane-1,3-diol and mixtures thereof; (f) 0.01% to 1.5%, of a preservative potentiator which is trisodium ethylene diamine-N,N-disuccinate; and (g) the balance being water.

5. The composition of claim 4, wherein at least one said sulfonate surfactant is said paraffin sulfonate.

6. The composition of claim 4 further including a sodium salt of an ethoxylated alkyl ether sulfate surfactant.

* * * * *